US007228675B2

(12) United States Patent
Wu

(10) Patent No.: US 7,228,675 B2
(45) Date of Patent: Jun. 12, 2007

(54) FILLING DEVICE AND METHOD FOR MAKING A MATTRESS

(76) Inventor: Hsin-Tsai Wu, 1F, No. 19, Alley 3, Lane 106, Sec. 3, Min-Chuan E. Rd., Taipei City (TW)

( * ) Notice: Subject to any disclaimer, the term of this patent is extended or adjusted under 35 U.S.C. 154(b) by 0 days.

(21) Appl. No.: 11/067,940

(22) Filed: Mar. 1, 2005

(65) Prior Publication Data

US 2006/0117710 A1 Jun. 8, 2006

(30) Foreign Application Priority Data

Dec. 6, 2004 (CN) ..... 2004 1 0096946

(51) Int. Cl.
*B65B 63/02* (2006.01)

(52) U.S. Cl. ..... 53/524; 53/95; 53/521; 141/67

(58) Field of Classification Search ..... 53/434, 53/436, 512, 521, 524, 473, 527, 530, 95, 53/103, 107; 141/67, 237, 242, 287, 290
See application file for complete search history.

(56) References Cited

U.S. PATENT DOCUMENTS 1,370,411 A * 3/1921 Contrado et al. ..... 19/144
3,695,486 A * 10/1972 Warner ..... 222/162
4,733,803 A * 3/1988 Sisson et al. ..... 222/276
5,377,727 A * 1/1995 Ueda et al. ..... 141/178
5,443,102 A * 8/1995 Svendsen ..... 141/10
5,531,252 A * 7/1996 Derby et al. ..... 141/67
5,651,401 A * 7/1997 Cados ..... 141/129
6,035,905 A * 3/2000 Griffin ..... 141/181
6,402,363 B1 * 6/2002 Maguire ..... 366/141
6,497,083 B1 * 12/2002 Garwood et al. ..... 53/244

* cited by examiner

*Primary Examiner*—Thanh Truong
(74) *Attorney, Agent, or Firm*—Banner & Witcoff, Ltd.

(57) ABSTRACT

A filling device for making a mattress includes a main frame, a feed vessel, a feeding platen, a capping structure, and a power mechanism. The feed vessel includes an open top and a bottom having supplying openings. The feeding platen includes filling containers. Each of the filling containers has an inlet and a gas-supplying unit. The capping structure includes caps. The power mechanism includes a power source and at least one actuating element driven by the power source to actuate the feeding platen to move between a first position in which the inlets of the filling containers are aligned respectively with the supplying openings of the feed vessel, and a second position in which the inlets of the filling container are closed respectively by the caps of the capping structure.

11 Claims, 6 Drawing Sheets

FILLING DEVICE AND METHOD FOR MAKING A MATTRESS

CROSS-REFERENCE TO RELATED APPLICATION

This application claims priority of Chinese Application No. 200410096946.9, filed on Dec. 6, 2004.

BACKGROUND OF THE INVENTION

1. Field of the Invention

The invention relates to a filling device, more particularly to a filling device for making a mattress. This invention also relates to a method for making the mattress.

2. Description of the Related Art

A conventional method for making a mattress includes providing a bag formed with a plurality of chambers by sewing, and filling a filling material, such as cotton and the like, into the chambers manually. Hence, the conventional method is both labor intensive and time wasting.

SUMMARY OF THE INVENTION

Therefore, it is an object of the present invention to provide a filling device for making a mattress in an efficient manner.

According to one aspect of the present invention, a filling device for making a mattress includes a main frame, a feed vessel, a feeding platen, a capping structure, and a power mechanism. The feed vessel is disposed at a top side of the main frame, and includes an open top and a bottom having a plurality of supplying openings. The feeding platen is disposed at the main frame below the feed vessel, and includes a plurality of filling containers. Each of the filling containers has an inlet and a gas-supplying unit. The capping structure is mounted on the main frame above the feeding platen, and includes a plurality of caps. The power mechanism includes a power source and at least one actuating element driven by the power source to actuate the feeding platen to move between a first position in which the inlets of the filling containers are aligned respectively with the supplying openings of the feed vessel, and a second position in which the inlets of the filling container are closed respectively by the caps of the capping structure.

According to another aspect of the present invention, a method for making a mattress includes the steps of:

(a) providing a filling device including:

a feed vessel including a plurality of supplying openings;

a feeding platen disposed below the feed vessel, and including a plurality of filling containers each having an inlet and a feeding opening;

a capping structure mounted above the feeding platen, and including a plurality of caps;

a movable baffle disposed proximate to the feed vessel, and including a plurality of openings; and a power mechanism for actuating the feeding plate and the movable baffle;

(b) providing a bag;

(c) supplying a filling material in the feed vessel;

(d) disposing the bag below the feeding openings of the filling containers;

(e) filling the filling material into the filling containers;

(f) closing the inlet of each of the filling containers; and (g) supplying a gas into the filling containers so as to fill the filling material into the bag.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
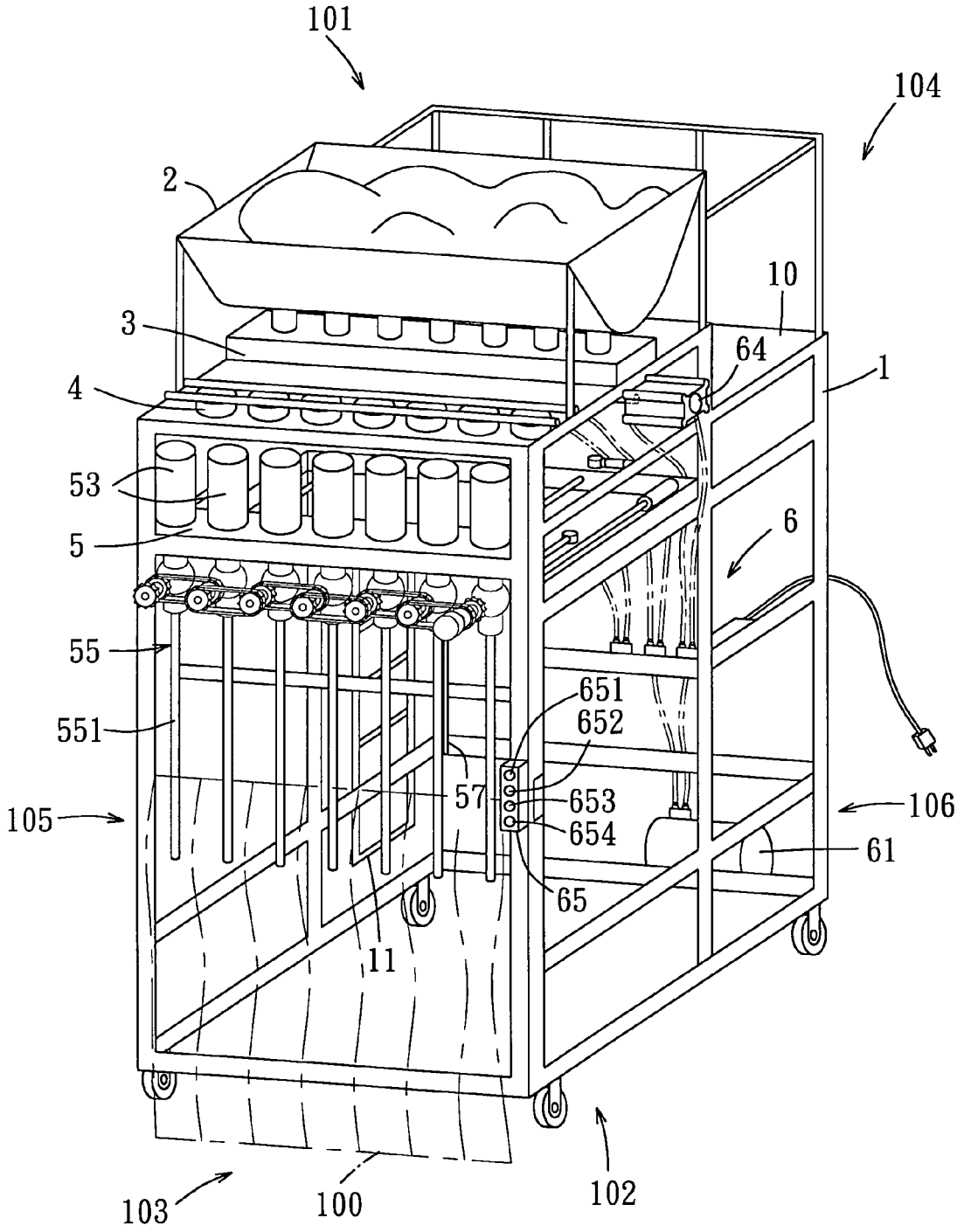
FIG. 1 is a perspective view of the first preferred embodiment of the filling device for making a mattress according to this invention.

Before the present invention is described in greater detail, it should be noted that like elements are denoted by the same reference numerals throughout the disclosure.

Figure 2:
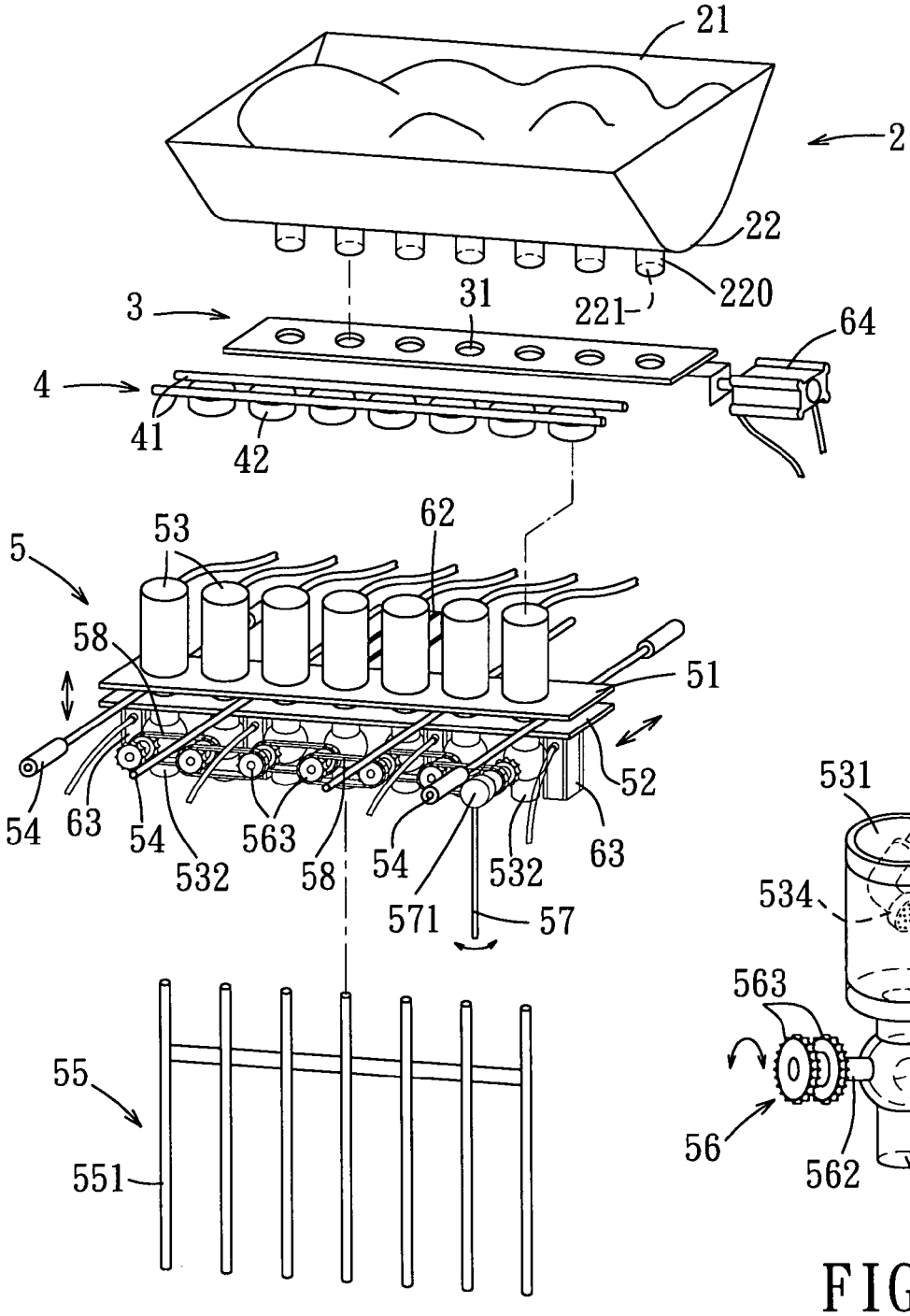
FIG. 2 is a fragmentary exploded perspective view showing some components used in the first preferred embodiment.

Referring to FIGS. 1 and 2, the first preferred embodiment of a filling device for making a mattress according to this invention is shown to include a main frame 1, a feed vessel 2, a feeding platen 5, a capping structure 4, a movable baffle 3, and a power mechanism 6.

The main frame 1 is made of angled steel, and includes a top side 101, a bottom side 102, a front side 103, a rear side 104, a left side 105, and a right side 106.

The feed vessel 2 is disposed transversely at the top side 101 of the main frame 1 and between the front and rear sides 103, 104 of the main frame 1, is configured in a hopper shape, and includes an open top 21 and a bottom 22 having a plurality of supplying passages 220 with supplying openings 221, respectively.

The main frame 1 further includes a platform 10 at the rear side 104 thereof, and a ladder 11 at the left side 105 thereof to enable an operator to supply a filling material for the mattress into the feed vessel 2. The filling material used for the mattress can be any suitable material well known in the art, such as foam, husk, and the like.

The feeding platen 5 is disposed at the main frame 1 below the feed vessel 2, and includes an upper plate 51, a lower plate 52 spaced apart from the upper plate 51, a plurality of slide rail members 54 mounted between the upper and lower plates 51, 52, and a plurality of filling containers 53 supported on the upper plate 51. Each of the upper and lower plates 51, 52 is formed in an elongate shape, and extends between the right and left sides 106, 105 of the main frame 1.

Figure 3:
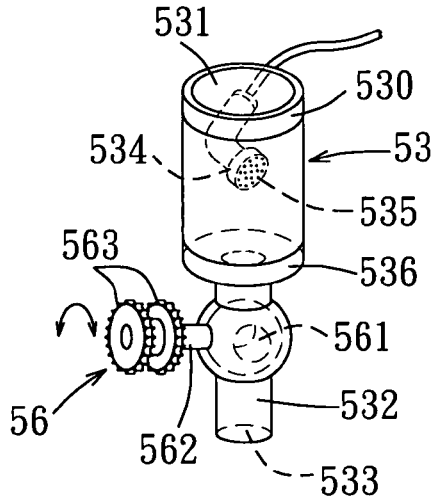
FIG. 3 is a perspective view of a filling container used in the first preferred embodiment.

Referring to FIG. 3, each of the filling containers 53 is used for filling the filling material from the feed vessel 2, and has an inlet 531 and a gas-supplying unit 534. Each of the filling containers 53 further includes a flexible sealing ring 530 around the inlet 531, a hopper portion 536, and a feeding tube 532 connected to the hopper portion 536 and extending out of the lower plate 52. The feeding tube 532 has a feeding opening 533 opposite to the hopper portion 536. In the preferred embodiment, the gas-supplying unit 534 is formed with a plurality of orifices 535. However, the gas-supplying unit 534 can be formed to have a single opening instead. Each of the filling containers 53 further includes a flow controller 56 having a ball valve 561 disposed in the feeding tube 532, a stem 562 connected to the ball valve 561 and extending out of the feeding tube 532, and two chain wheels 563 disposed on the stem 562 outwardly of the feeding tube 532. The feeding platen 5 further includes a plurality of chains 58, each of which interconnects two chain wheels 563 provided at two neighboring filling containers 53, respectively. The feeding platen 5 further includes a flow-controlling bar 57 connected to the chain wheel 563 of the flow controller 56 of one of the filling containers 53 by a wheel disc 571. The flow controllers 56 can be operated by the flow-controlling bar 57 to control the ball valves 561 for opening or closing the feeding tubes 532.

Referring again to FIGS. 1 and 2, the capping structure 4 is mounted on the main frame 1 above the feeding platen 5, and includes two transverse bars 41 spaced apart from each other and spanning the right and left sides 106, 105 of the main frame 1, and a plurality of caps 42 welded to and located below the transverse bars 41.

The movable baffle 3 is disposed at the main frame 1 proximate to the bottom 22 of the feed vessel 2, and includes a plurality of openings 31.

The power mechanism 6 includes a power source 61, a first actuating element 62, a plurality of second actuating elements 63, a third actuating element 64, and a switch set 65.

The first actuating element 62 is mounted on the feeding platen 5, and is driven by the power source 61 to actuate the feeding platen 5 to move between a first position in which the inlets 531 of the filling containers 53 are aligned respectively with the supplying openings 221 of the feed vessel 2, and a second position in which the inlets 531 of the filling containers 53 are closed respectively by the caps 42 of the capping structure 4.

The second actuating elements 63 are mounted on the lower plate 52 of the feeding platen 5, and are driven by the power source 61 to actuate the feeding platen 5 to move toward and away from the feed vessel 2 when the feeding platen 5 is at the first position, and to move toward and away from the capping structure 4 when the feeding platen 5 is at the second position.

The third actuating element 64 is mounted on the movable baffle 3 proximate to the right side 106 of the main frame 1 to actuate the movable baffle 3 to move between an aligning position in which each of the openings 31 of the movable baffle 3 is aligned with a corresponding one of the supplying openings 221 of the feed vessel 2, and an offset position in which each of the openings 31 of the movable baffle 3 is offset from a corresponding one of the supplying openings 221 of the feed vessel 2.

The switch set 65 includes a first switch 651, a second switch 652, a third switch 653, and a fourth switch 654. The first switch 651 is connected electrically to the third actuating element 64 so as to control the movement of the movable baffle 3 between the aligning position and the offset position. The second switch 652 is connected electrically to the first actuating element 62 so as to control the movement of the feeding platen 5 between the first position and the second position. The third switch 653 is connected electrically to the second actuating elements 63 so as to control the movement of the feeding platen 5 toward and away from the feed vessel 2 or the capping structure 4. In the preferred embodiment, the power source 61 is an air compressor. The first, second, and third actuating elements 62, 63, 64 are pneumatic cylinders connected to the power source 61 through hoses and gas valves.

The fourth switch 654 is connected electrically to the gas-supplying unit 534, which is communicated with the power source 61 (i.e., the air compressor) through a hose. When the fourth switch 654 is turned on, compressed air from the power source 61 flows into the filling containers 53 via the orifices 535 of the gas-supplying units 534. Each of the gas-supplying units 534 is disposed at a downward inclined angle relative to the wall of a corresponding one of the filling containers 53 so as to facilitate filling of the filling material into each of the filling containers 53.

Additionally, the filling device includes a filling tube set 55 having a plurality of filling tubes 551, each of which is removably connected to the feeding opening 533 of the feeding tube 532 of a corresponding one of the filling containers 53. The number of the filling tubes 551 corresponds to the number of the filling containers 53, the caps 42, the openings 31 of the movable baffle 3, and the supplying passages 220 of the feed vessel 2, and is varied according to the number of the chambers of a bag 100 for a mattress.

Additionally, in practice, a plurality of limit switches (not shown) can be provided at the filling device so as to sense and limit the movement of the feeding platen 5 and the movable baffle 3.

Figure 4:
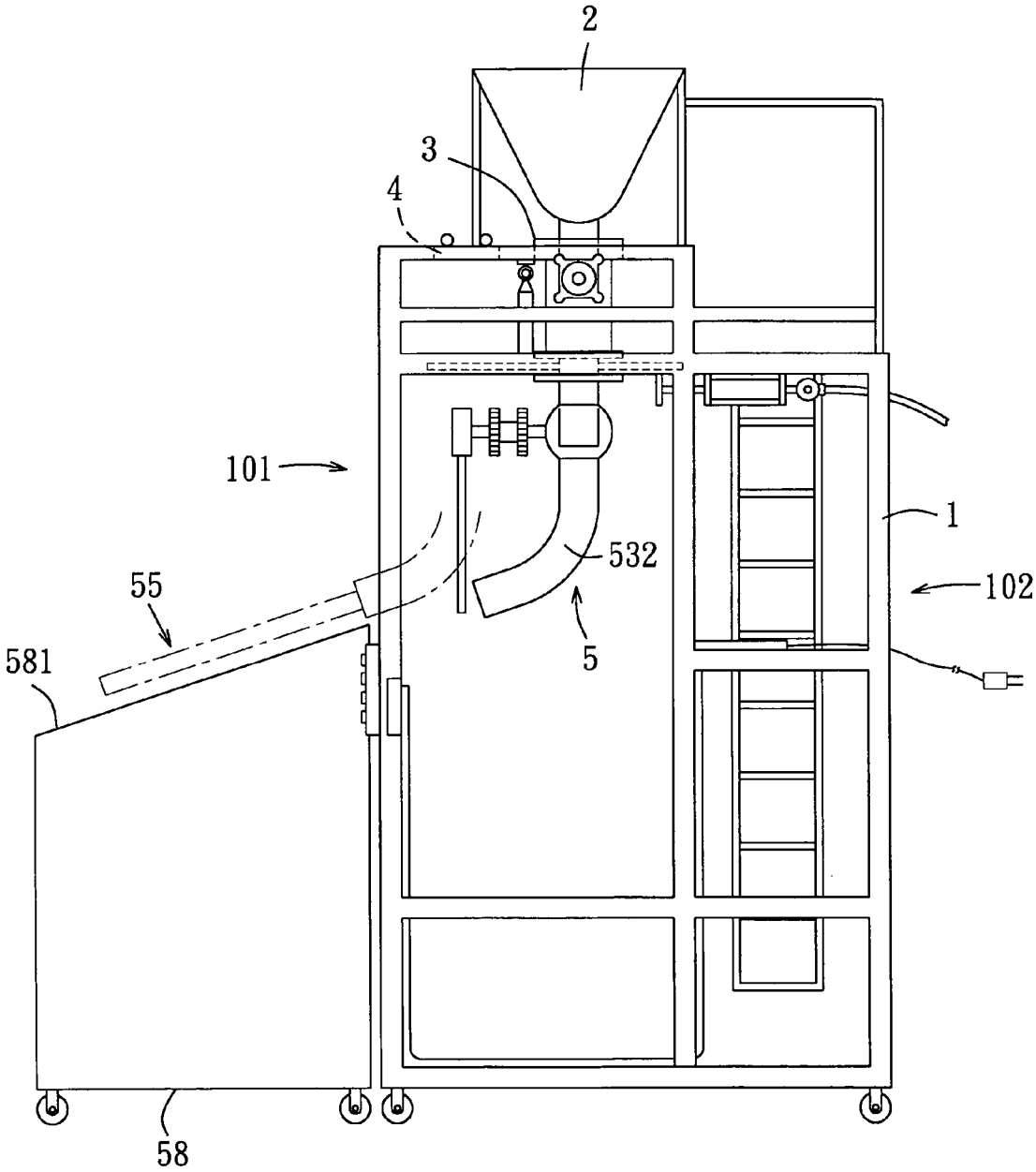
FIG. 4 is a side view of the second preferred embodiment of the filling device for making a mattress according to this invention.

Referring to FIG. 4, the second preferred embodiment of a filling device for making a mattress according to this invention is substantially identical to the first preferred embodiment, except that the feeding tubes 532 in the second preferred embodiment are bent at an angle relative to a vertical line and are directed toward the front side 101 of the main frame 1, and that the filling device further includes a support frame 58 mounted proximate to the front side 101 of the main frame 1, and having a sloped surface 581 corresponding to the angle of the feeding tubes 532.

Figure 5:
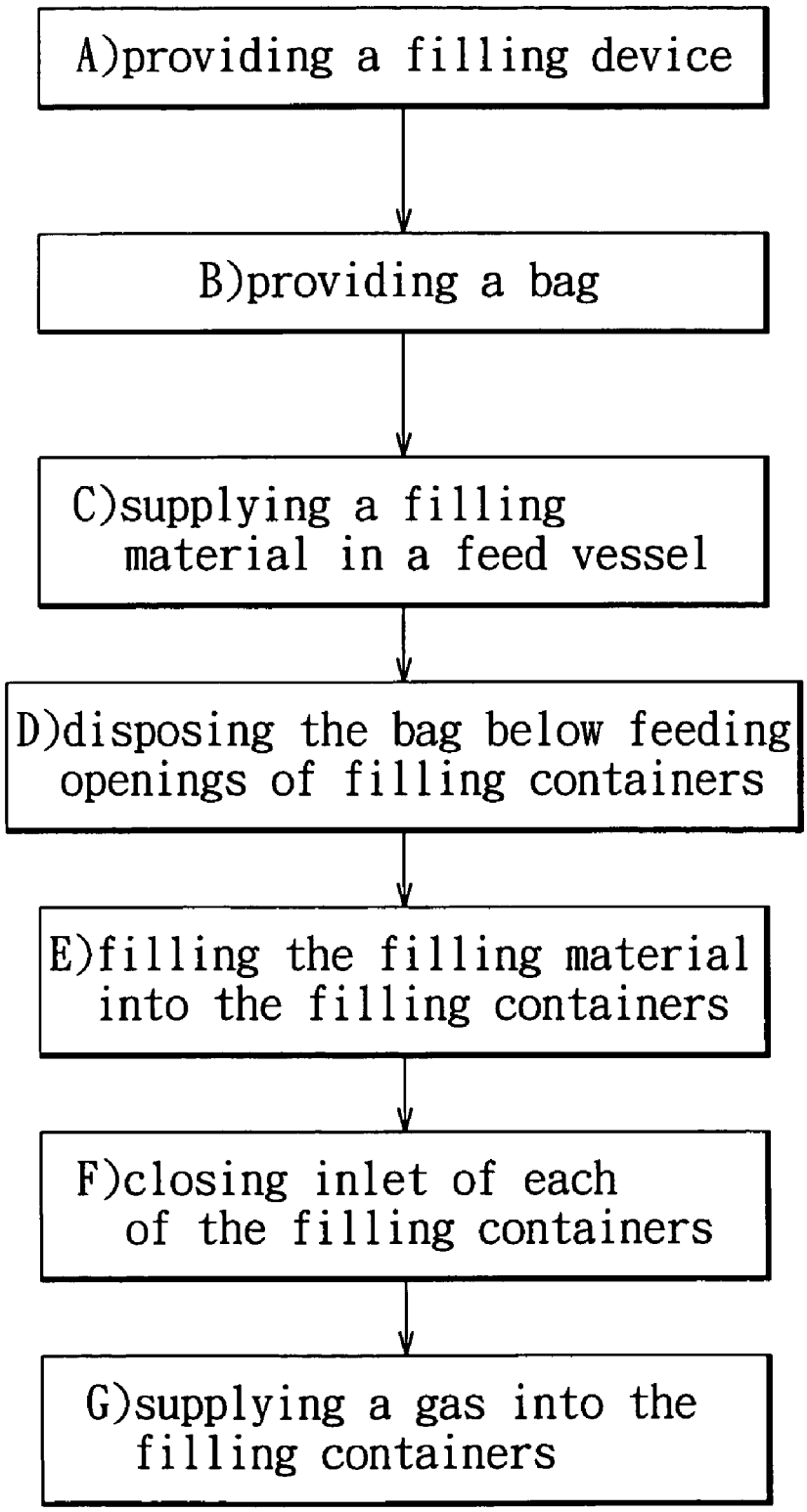
FIG. 5 is a flow diagram of the preferred embodiment of the method for making a mattress according to this invention.

Referring to FIGS. 1 and 5, the preferred embodiment of a method for making a mattress according to this invention includes the steps of: A) providing the aforesaid filling device shown in FIG. 1; B) providing a bag 100 having a plurality of filling chambers; C) supplying a filling material in the feed vessel 2; D) disposing the bag 100 below the feeding openings of the filling containers, and inserting the filling tubes 551 into the filling chambers of the bag 100, respectively; E) filling the filling material into the filling containers 53; F) closing the inlet 531 of each of the filling containers 53; and G) supplying a gas into the filling containers 53 so as to fill the filling material into the bag 100.

Figure 6:
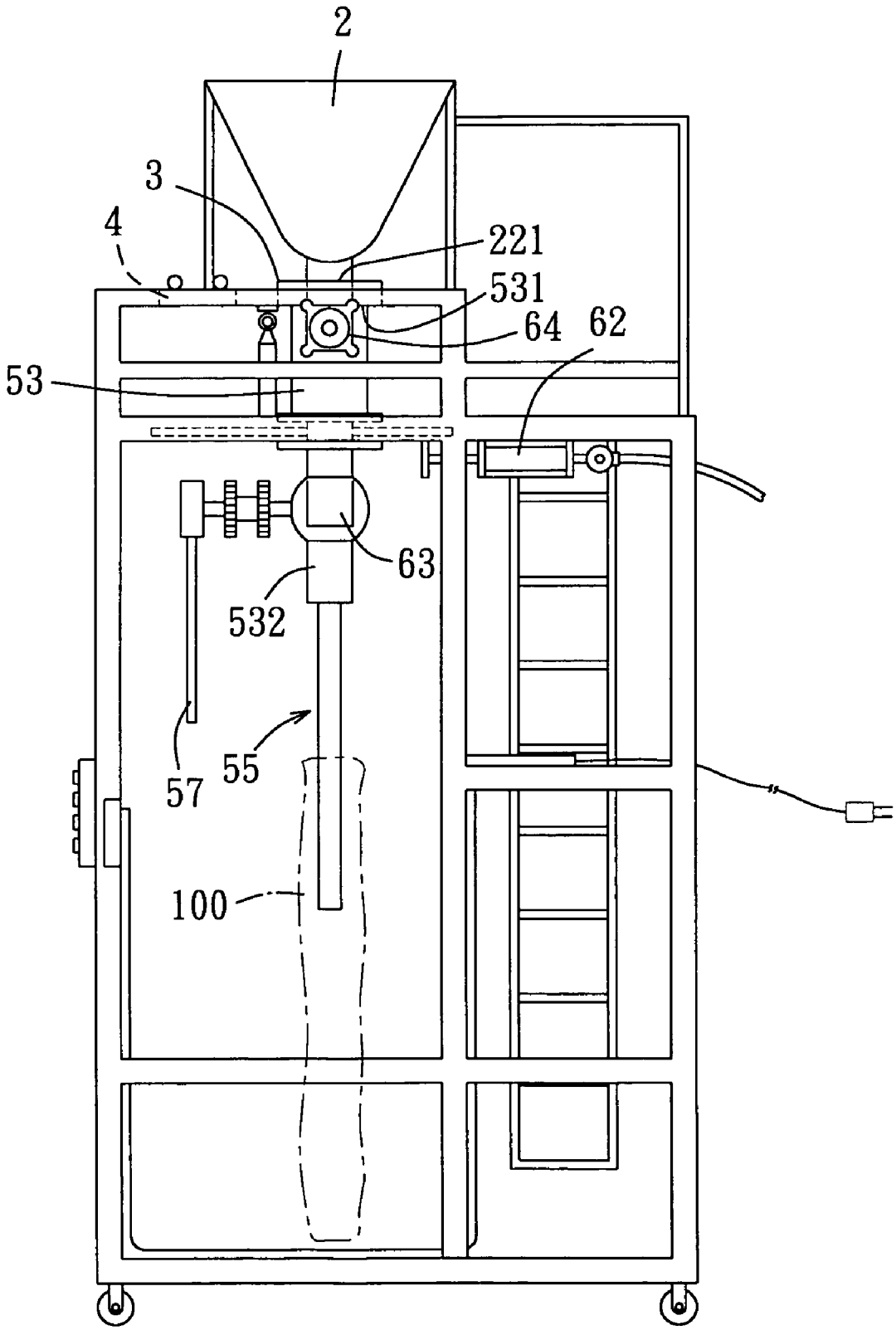
FIG. 6 is a schematic view showing a first position of a feeding platen.
Figure 7:
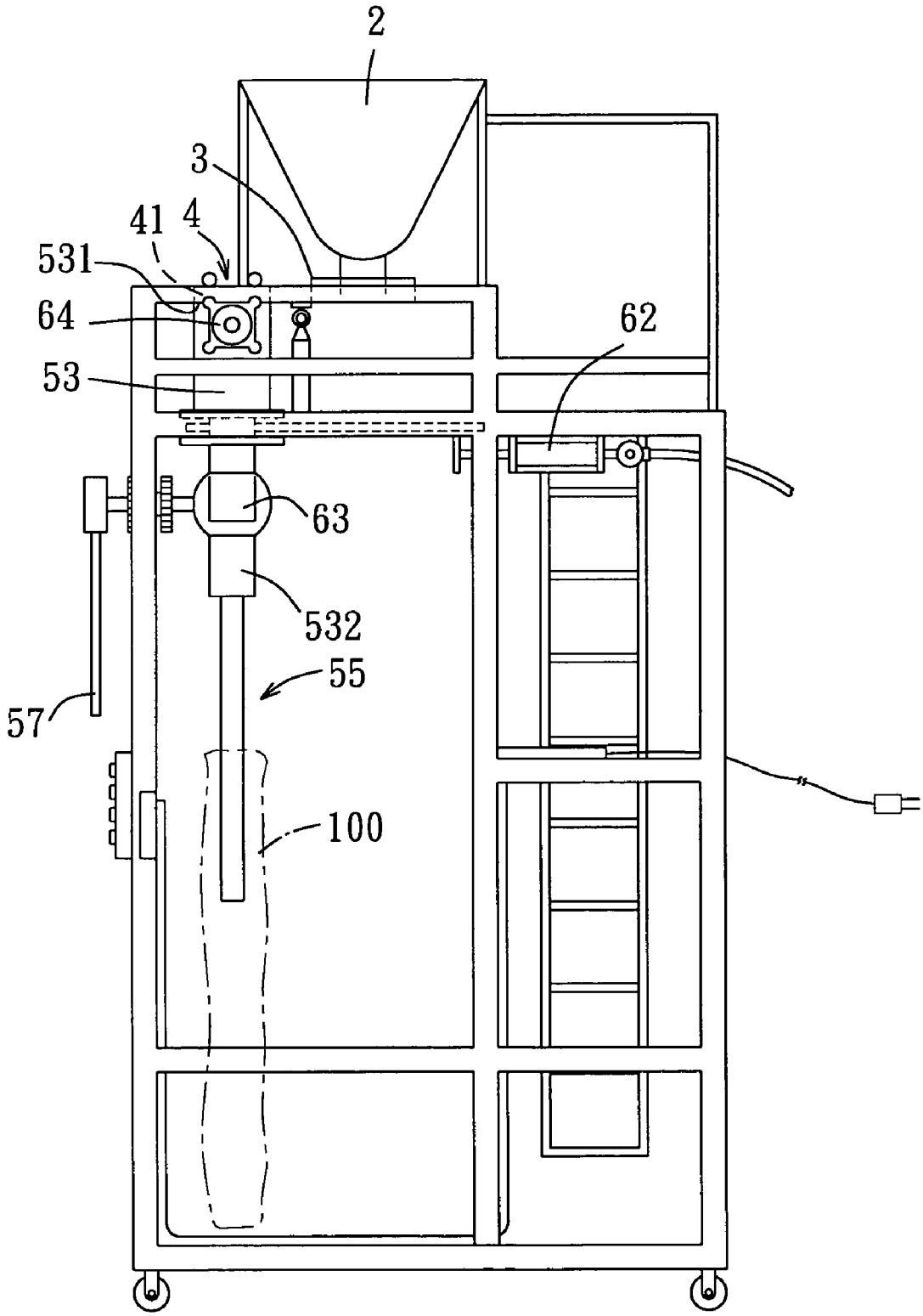
FIG. 7 is a schematic view showing a second position of the feeding platen.

In the step C), the movable baffle 3 is moved upon activation of the first switch 651 of the power mechanism 6 so as to close the supplying openings 221 of the feed vessel 2, and the filling material is then supplied into the feed vessel 2. In the step E), by operating the second and third switches 652,653 of the power mechanism 6, the feeding platen 5 is moved below the feed vessel 2, and the movable baffle 3 is then moved by operating the first switch 651 to align the filling containers 53 with the openings 31 of the movable baffle 3 and the supplying openings 221 of the feed vessel 2, respectively, so as to fill the filling material into the filling containers 53, as best shown in FIG. 6. In the step F), the filling containers 53 are moved by operating the second and third switches 652, 653 below the capping structure 4 through the power mechanism 6 so as to close the inlet 531 of each of the filling containers 53 by the corresponding one of the caps 42 of the capping structure 4, as best shown in FIG. 7. In the step G), the ball valve 561 of each of the filling containers 53 is moved by operating the flow-controlling bar 57 so as to open the feeding tube 532 of each of the filling containers 53 and to permit the filling material to flow into the bag 100 through the feeding tube 532 of each of the filling containers 53. By operating the fourth switch 654, the gas is supplied by the power source 61 (i.e., the air compressor) to facilitate the movement of the filling material into the bag 100. Each of the filling containers 53 includes the gas-supplying unit 534 communicated with the power source 61 so as to supply the gas from the power source 61 to each of the filling containers 53 through the gas-supplying unit 534.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A filling device for making a mattress, comprising:

a main frame;

a feed vessel disposed at a top side of said main frame, and including an open top and a bottom having a plurality of supplying openings;

a feeding platen disposed at said main frame below said feed vessel, and including a plurality of filling containers each having an inlet and a gas-supplying unit, said filling containers being mounted on said feeding platen to move along with said feeding platen;

a capping structure mounted on said main frame above said feeding platen, and including a plurality of caps; and a power mechanism including a power source and at least one first actuating element driven by said power source to actuate said feeding platen to move between a first position in which said inlets of said filling containers are aligned respectively with said supplying openings of said feed vessel, and a second position in which said inlets of said filling containers are closed respectively by said caps of said capping structure.

2. The filling device as claimed in claim 1, wherein said power mechanism further includes at least one second actuating element driven by said power source to actuate said feeding platen to move toward and away from said feed vessel when said feeding platen is at said first position, and to move toward and away from said capping structure when said feeding platen is at said second position.

3. The filling device as claimed in claim 2, further comprising a movable baffle disposed at said main frame proximate to said bottom of said feed vessel, and including a plurality of openings, said power mechanism further including at least one third actuating element to actuate said movable baffle to move between an aligning position in which each of said openings of said movable baffle is aligned with a corresponding one of said supplying openings of said feed vessel, and an offset position in which each of said openings of said movable baffle is offset from a corresponding one of said supplying openings of said feed vessel.

4. The filling device as claimed in claim 1, wherein said feeding platen further includes an upper plate for supporting said filling containers, a lower plate spaced apart from said upper plate, and slide rail members mounted between said upper and lower plates.

5. The filling device as claimed in claim 4, wherein each of said filling containers includes a hopper portion, and a feeding tube connected to said hopper portion and extending out of said lower plate, said feeding tube having a feeding opening opposite to said hopper portion.

6. The filling device as claimed in claim 5, wherein each of said filling containers further includes a flow controller having a ball valve disposed in said feeding tube, a stem connected to said ball valve and extending out of said feeding tube, and at least one chain wheel disposed on said stem outwardly of said feeding tub.

7. The filling device as claimed in claim 6, wherein said feeding platen further includes a chain interconnecting said chain wheels of said filling containers, and a flow-controlling bar connected to said chain wheel of said flow controller of one of said filling containers.

8. The filling device as claimed in claim 5, further comprising a plurality of filling tubes each removably connected to said feeding opening of said feeding tube of a corresponding one of said filling containers.

9. The filling device as claimed in claim 1, wherein each of said filling containers has a flexible sealing ring around said inlet.

10. The filling device as claimed in claim 5, wherein said feeding tube is bent at an angle relative to a vertical line and is directed toward one side of said main frame.

11. The filling device as claimed in claim 10, further comprising a support frame mounted proximate to said one side of said main frame, and having a sloped surface corresponding to said angle of said feeding tube.

* * * * *